US005655763A

United States Patent [19]

Gerlier

[11] Patent Number: 5,655,763

[45] Date of Patent: Aug. 12, 1997

[54] APPARATUS FOR EMPTYING DOCUMENT BOXES

[75] Inventor: André Gerlier, Sciez, France

[73] Assignee: Mars Incorporated, McLean, Va.

[21] Appl. No.: 464,671

[22] PCT Filed: Dec. 29, 1993

[86] PCT No.: PCT/GB93/02669

§ 371 Date: Jul. 28, 1995

§ 102(e) Date: Jul. 28, 1995

[87] PCT Pub. No.: WO94/16410

PCT Pub. Date: Jul. 21, 1994

[30] Foreign Application Priority Data

Dec. 30, 1992 [EP] European Pat. Off. ..... 92122133

[51] Int. Cl.[6] ..... B65H 1/00

[52] U.S. Cl. ..... 271/162; 271/164

[58] Field of Search ..... 271/163, 162, 271/164, 145, 34, 10.06; 209/534; 902/9, 12; 232/43.1, 43.5; 109/47, 51, 52, 50, 73, 67

[56] References Cited

U.S. PATENT DOCUMENTS

| | | | |
|---|---|---|---|
| 4,189,139 | 2/1980 | Uchida et al. | 271/162 |
| 4,235,433 | 11/1980 | Hirata | 271/162 |
| 4,540,081 | 9/1985 | Mori et al. . | |
| 4,669,393 | 6/1987 | Wuthrich . | |
| 4,993,556 | 2/1991 | Gerlier | 209/534 |

FOREIGN PATENT DOCUMENTS

| | | |
|---|---|---|
| 0004436 | 10/1979 | European Pat. Off. . |
| 0166041 | 1/1986 | European Pat. Off. . |
| 0182137 | 5/1986 | European Pat. Off. . |
| 0182760 | 5/1986 | European Pat. Off. . |
| 0197899 | 10/1986 | European Pat. Off. . |
| 0307375 | 3/1989 | European Pat. Off. . |
| 2453811 | 11/1980 | France . |
| 2587012 | 3/1987 | France . |
| 2620690 | 3/1989 | France . |
| 658736 | 11/1986 | Switzerland . |
| 1210027 | 6/1989 | United Kingdom . |

*Primary Examiner*—David H. Bollinger
*Attorney, Agent, or Firm*—Fish & Richardson P.C.

[57] ABSTRACT

An apparatus for withdrawing banknotes from a cashbox is disclosed. The apparatus includes a housing for receiving a locked cashbox having a door which is openable within the housing. The outer housing prevents manual extraction of the cashbox contents when the cashbox door is open. A handling and transport mechanism is contained in the outer housing to remove the cashbox contents and perform processing of the contents.

18 Claims, 2 Drawing Sheets

APPARATUS FOR EMPTYING DOCUMENT BOXES

FIELD OF THE INVENTION

The present invention concerns the field of apparatuses intended for emptying boxes receiving documents, particularly banknotes, introduced by the users into selectors and stacked in the boxes by the selectors.

BACKGROUND OF THE INVENTION

Such boxes, such as for example that described in Patent CH-658 736, are provided with security systems which prevent any possibility of access to the stacked notes by the personnel entrusted with extracting these boxes from the selectors of these automatic machines.

It is known, for example from application FR-79 09576 or from U.S. Pat. No. 4,540,081, to provide a piston which introduces into the box, through a slot, the documents presented in succession by the selector. This slot is generally in the shape of a rectangle, the length of which is slightly greater than the longest length envisaged for the documents accepted by the selector, and a width which is less than the smallest width envisaged for the documents accepted by the selector. In a known manner, the piston ends in a plunger entering the slot sufficiently deeply to introduce the document into the box, against a presser plate supporting the other documents, already stacked, and which plate is pushed towards the face of the box where the slot is situated by mechanical return means, such as for example a spring. The slot of this type of box is automatically obstructed by a flap as soon as the box is extracted from the selector.

An apparatus for emptying such boxes is described for example in the published application EP-0 182 760.

In modern selectors, the user can not only introduce different types of documents through the same aperture, but also present them in any one of the four possible orientations which are a priori possible for a nonsymmetrical rectangular sheet of paper. The only restriction is that the document should be introduced in the direction parallel to its largest dimension. This is guaranteed by the choice of the width of the aperture of the selector, less than the smallest length envisaged for the documents accepted by the selector. This feature makes it possible, among other things, to ensure that the document is completely introduced through the slot by the piston.

The apparatus described in application EP-0 182 760 does not permit the turning of notes which might be presented in a direction which did not allow them, for example, to be tested as to their authenticity.

The document U.S. Pat. No. 4,993,556 describes an apparatus for arranging the documents all in the same direction, that is to say, capable of turning the documents to a predetermined orientation with a view to their subsequent treatment, for example, in the case of bank notes, to put them into identically stacked bundles.

The apparatus described in U.S. Pat. No. 4,993,556 requires manual presentation of the documents into the feeder, which raises problems of security, linked to the risk of being abstracted by personnel, when these documents are bank notes. The document EP-0 182 760 makes no mention of theft-proof or closed boxes making it possible to prevent any attempt at theft by the personnel maintaining the boxes. The apparatus thus described therefore makes it necessary to work with persons who are completely trustworthy, or under permanent surveillance with a sophisticated access control system in the room where the apparatus is located. It does not permit simple processing of the box by unqualified persons in general purpose premises.

SUMMARY OF THE INVENTION

The invention aims to remedy the drawbacks described previously.

A type of box that can be used is for example that described in Patent CH-658 736.

In a first general form of embodiment of the invention, the opening means consist of a door which can be opened only when the box is correctly inserted. This door can be lateral, that is to say that in the closed position the plane of the door intersects at a right angle the dihedron formed on the one hand by the side of the box on which is located the slot permitting the stacking of the documents, and on the other hand the plane of the only side of the box which remains entirely visible to the person having inserted the box while it is emptied. This lateral door opens by pivoting for example about a horizontal or vertical axis, towards the person having inserted the box, as far as a fully open position corresponding for example to a pivoting angle of at least 90°, to allow the collecting system to come into action. The volume swept by the door corresponds to a concave cylindrical shape provided in the apparatus, this revolution cylinder having as its axis the pivoting axis of the door, a height slightly greater than the height of the door, a radius slightly greater than the width of the door, the clearances between these dimensions being sufficient to prevent the door from scraping the concave shape during opening, but insufficient to slip the hand or any kind of tool into it. The fully open position is detected by the apparatus, for example by closure of a contact, and the door may for example be locked in this fully open position throughout the operation of emptying the box. The concave cylindrical shape can then allow the collecting system to pass, not without means being utilised to stop the manoeuvre if the door does not remain locked in the fully open position.

In a particular embodiment of the invention, the slot of the box is automatically unlocked, by retraction of the flap, on insertion of the box into the apparatus.

In a particular embodiment of the invention, the slot of the box, once the box has been placed in position, can only be unlocked by the action of a key in a lock placed on the side of the box which remains accessible to the operator.

In a particular embodiment of the invention, a presser piston passes through the slot once the flap is retracted, to bring the top of the pile of documents to a predetermined level, which can be selected as the working level of the document collecting system. The mechanical return means, which may for example be a spring, provide the automatic compensation for the decrease in thickness of the pile, as the collecting system repeatedly withdraws the document situated at the top of the pile. This makes it possible, even when the box is loaded to its full capacity at the start of the operation, to disengage the portion of the box located in the vicinity of the slot, which facilitates the functioning of the collecting system which depends on the note. This piston may be equipped with indentations into which fit the parts of the collecting system coming into contact with the top of the pile.

A particular embodiment of the invention, includes a collecting system which comprises means for gripping the surface of the topmost document of the pile. These gripping means may for example consist of suction cups, in which the reduction of pressure may for example be controlled by a pneumatic system installed in the apparatus. These means can supplement the known action of rollers which rub against the edge of the documents at the top of the pile in order to separate the documents laterally to a sufficient degree for the collecting system to take only the topmost document of the pile. The collecting system may for example use elements described in U.S. Pat. No. 5,116,037.

In a particular embodiment of the invention, the documents grasped by the collecting system are conveyed by a transport system, known per se for subsequent treatment. This treatment may in particular comprise their arrangement all in the same direction, in order to form homogenous bundles. This arrangement all in the same direction can be carried out in a sub-assembly of the apparatus, termed a turning mechanism, after the documents have been analyzed from the point of view of their orientation, for example by means of a reading head, then turned if necessary by rotation through 180° about one or more axes passing through their centre, the nature of these rotations depending on the results of the reading. This treatment can also comprise checks designed specifically to judge the state of wear of the document, in order to switch the excessively worn documents towards an auxiliary box for subsequent manual sorting. It may also comprise checks for authenticity of the documents, as well as storing in memory the position of the false documents in the pile, in order to locate the circumstances of the fraud which has occurred in the selector. Finally, it may comprise a system for sorting documents by face value, and optionally by currency if the corresponding selectors accept notes of several currencies. Such systems are described for example in Patent CH-57364.

In a particular embodiment of the invention, means are provided to prevent any attempt at fraud aimed at simulating the locking of the door, the latter not being in the fully open position. These means may consist of a feeler moving parallel to the collecting system, on a trajectory situated between the path of the collecting system and the fully open position of the door. This trajectory can only be travelled by the feeler without hindrance if the door is indeed in the fully open position. If the feeler encounters an obstacle, it blocks all the sequence of operations until the intervention of a security agent.

In a particular embodiment of the invention, the door is opened automatically by the apparatus. The task of the operator consists simply in inserting the box properly, after which a latch locks the box in this position until the last document is extracted from the box. The apparatus can then function without particular access precautions at the site where it is located.

In a second general form of embodiment of the invention, the box is composed of two parts which can slide relative to each other, this sliding being possible only when the box is correctly inserted into the apparatus. The opening means then cause on part of the box, which is movable in relation to the frame of the apparatus, to slide, the other part of the box remaining anchored in the apparatus by the insertion device. This sliding may for example be started off automatically by the apparatus when all possibility of access is banned to the operator, for example when an access door to the inside of the apparatus is closed by the operator. When the movable part of the box has slid as far as it will go, it can, by closing a contact, set in operation the presser piston and the document collecting system.

Preferably, in this embodiment of the invention, the part of the box remaining stationary in relation to the frame of the apparatus is in the form of a parallelepipedal box in which slides a drawer containing the documents, the system functioning to a certain extent like a matchbox. This embodiment has the advantage of a simple design of the envelope of the box, in particular avoiding pivots, lock and door jamb.

Other forms of embodiment are described in the claims. Further advantages of the invention will be revealed in the detailed description which follows, with reference to the figures.

DETAILED DESCRIPTION

Figure 1:
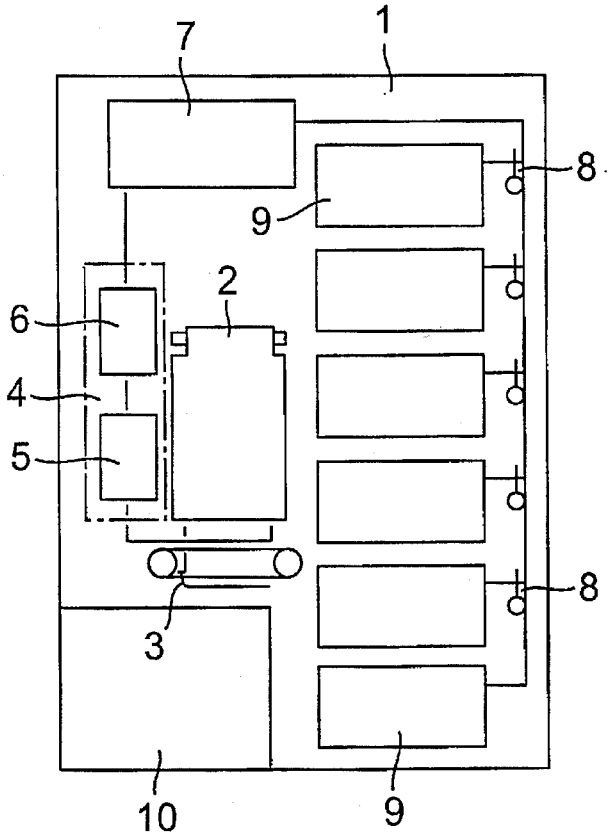
FIG. 1 is a diagrammatic top view of an embodiment of apparatus according to the invention.

FIG. 1 shows an embodiment of the invention in which a box 2 comprises means for opening (not shown in FIG. 1) by sliding of one part of the box 2. The figure shows the whole of the apparatus 1 into which the box for notes 2 has already been inserted, by an operator who may for example be the person charged with the collection of the boxes in the selectors of the automatic machines. A collecting system (not shown in FIG. 1) transfers the notes one after the other to a transport system 3. This transport system conveys the notes (preferably without allowing access thereto from the exterior of the apparatus 1) successively:

- into a checking sub-assembly 4 comprising a reading head 5 that can determine the face value of the notes and also their orientation, and a wear checking means 6 identifying the notes too worn to be put back into circulation;
- into a turning mechanism 7 controlled by the data acquired by the reading head 5;
- into a sorting sub-assembly comprising switching means 8, which are also controlled by the data acquired by the reading head 5, and which direct the notes towards outlet boxes 9. These outlet boxes may have security devices analogous to those of the selector boxes of the type of that 2 inserted into the apparatus. These devices may in particular comprise a lock, the impossibility of actuating certain openings except under certain conditions, such as for example the insertion of the box into determinate apparatuses, and also the obligatory observance of a certain sequence in the operation of the apparatuses in which the box is inserted. These security devices make it possible to avoid errors by negligence of the collecting personnel, consisting for example in replacing in a selector a box 2 not previously emptied by the apparatus 1, as well as attempts at fraud. These outlet boxes may even be identical to the boxes 1, or, in a low cost version, be in the form of simple open boxes. The first box is preferably arranged to receive those banknotes detected by the means 6 to be unsuitable due to wear for putting back into circulation.

An electronic compartment 10 controls and supervises the whole process.

In FIG. 1, the box 2 has already been inserted into the apparatus by the operator. Its placement inside the housing or frame 12 (FIGS. 2 and 3) makes it possible to isolate the box 2 easily from any access from the outside of the frame 12 when the opening means 17 are actuated.

Figure 3:
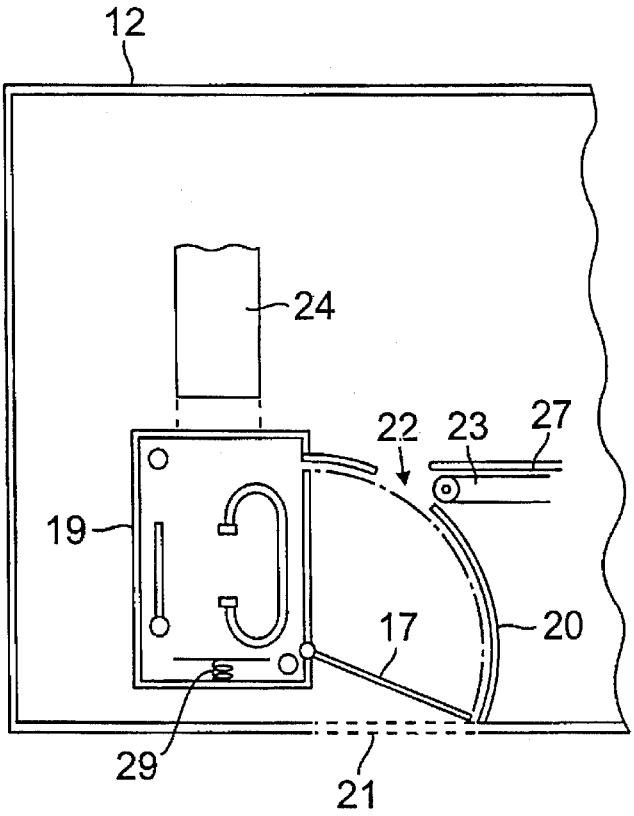
FIG. 3 is a side view of the box inserted in the apparatus, showing more particularly the door and the concave cylindrical shape.
Figure 2:
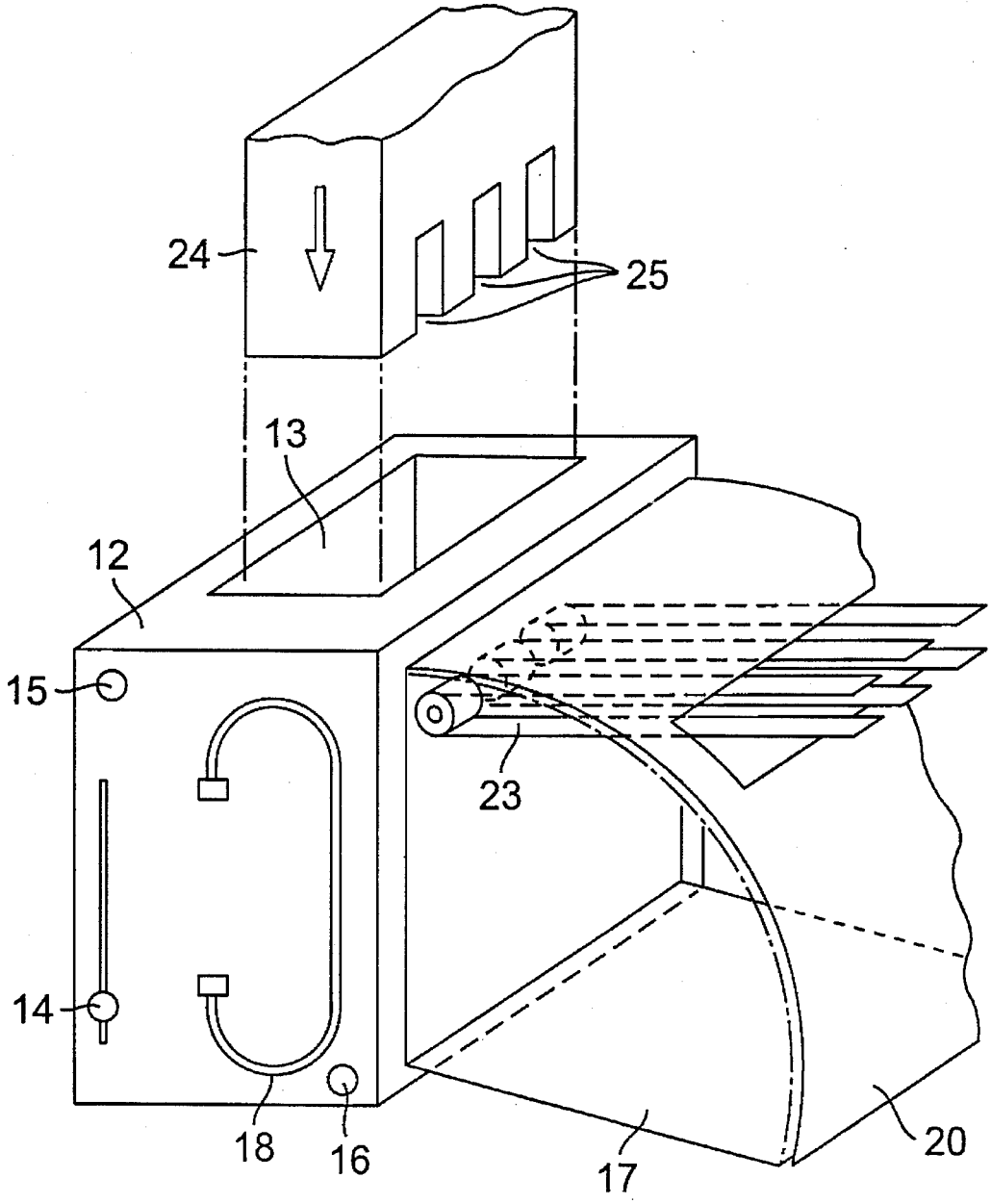
FIG. 2 is a perspective view of the box inserted in the apparatus and of certain parts of the apparatus.

FIGS. 2 and 3 show respectively a perspective view and a profile view of the box 2, in an embodiment of the invention wherein the means for opening the box 2 comprise a pivoted door 17. These figures also show in greater detail the functioning of the presser piston bringing the top of the pile to the level of the working plane of the collecting system.

The box 2 comprises a slot 13 through which the selector has previously introduced the notes. This slot 13 is automatically locked by a flap actuated by a lever 14 as soon as the operator has withdrawn the box 2 from the selector of the automatic machine. Optionally, the box 2 may be equipped with a lock 15 which the operator must actuate by means of a key so that the lever 14 can act on the flap in the direction of unlocking of the slot 13. The door 17 of the box 2 can only be unlocked, optionally by the action of a second lock 16, if the box 2 is properly inserted into the frame 12 (FIG. 3) of the apparatus 1 by means of the handle 18. In the insertion position, the slot 13 is not accessible to the operator. An opening 21 provided in the frame 12 allows the operator to open the door 17 manually by a handle (not shown) if this process is not undertaken automatically by the apparatus 1. A concave cylindrical shape 20 forming part of the frame 12 (FIG. 3) corresponds to the volume generated by the rotation of the door 17, which also prevents the operator from gaining access to the inside of the box 2 through the opening 21. When the door 17 is locked in the fully open position, an opening 22 provided in the concave cylindrical shape opens to allow the passage of a collecting system 23 which penetrates into the box 2. In order to prevent fraudulent simulation of locking of the door 17, a feeler device 27 which moves parallel to the collecting system 23 may be provided to ensure that the door is fully open. If the feeler 27 encounters an obstacle, it blocks all operations until a security agent intervenes. At the same time, the lever 14 unlocks the slot 13 and a presser piston 24, provided with indentations 25, descends through the slot 13 to pack down the pile of notes. A presser plate and mechanical return means 29, wherein the return means may be a spring, may be included in the box 2 to provide automatic compensation for the decrease in thickness of the pile of notes. The collecting system comprises projecting elements each in the form of a respective (preferably individually driven) endless belt. The indentations 25 are wide enough to allow the furthest projecting elements of the collecting system 23 to pass. The belts engage the uppermost banknote of the stack so that the notes can be withdrawn from the box one at a time.

I claim:

1. Apparatus for withdrawing banknotes from a cashbox, the apparatus comprising a housing for receiving a locked cashbox having a door which is openable within the housing, and means provided within the housing for withdrawing the banknotes from the door of the cashbox and for delivering them to a receiving means, wherein the door is pivotally mounted on the cashbox, and a portion of the housing has a shape conforming to the path of the door, and allowing manual access to the door, during the opening thereof, and said portion of the housing encloses the volume generated by rotation of the door with sufficiently small clearance to prevent manual extraction of banknotes.

2. Apparatus as claimed in claim 1, further including means for sorting the banknotes withdrawn from the cashbox.

3. The apparatus of claim 2, further including a plurality of outlet boxes for receiving the sorted banknotes.

4. Apparatus for withdrawing banknotes from a cashbox, the apparatus comprising a housing for receiving a locked cashbox having a door which is openable within the housing, and means provided within the housing for withdrawing the banknotes from the door of the cashbox and for delivering them to a receiving means, wherein the housing has an opening allowing manual access to the door without allowing access to the interior of the cashbox, the apparatus including means for detecting whether the door is in a fully open position and for inhibiting operation of the apparatus if the fully open position is not detected.

5. Apparatus as claimed in claim 4, further including means for sorting the banknotes withdrawn from the cashbox.

6. The apparatus of claim 5, further including a plurality of outlet boxes for receiving the sorted banknotes.

7. Apparatus for withdrawing banknotes from a cashbox, the apparatus comprising a housing for receiving a locked cashbox which is openable within the housing, wherein the apparatus comprises a piston for entering the cashbox via a first aperture and engaging a stack of banknotes so as to position an end of the stack at a predetermined location, and withdrawing means for entering a cashbox via a second aperture, engaging the end of the stack at said predetermined location an withdrawing the banknotes from the cashbox.

8. Apparatus as claimed in claim 7, wherein the first aperture is an aperture adapted for banknote insertion.

9. Apparatus as claimed in claim 7, wherein the piston has recesses to allow the withdrawing means to engage the end of the stack.

10. Apparatus as claimed in claim 9, wherein the withdrawing means comprises a plurality of belts insertable into respective ones of said recesses in the piston for engaging the endmost banknote of the stack.

11. Apparatus as claimed in claim 7, wherein the withdrawing means is movable in a plane perpendicular to the direction of movement of the piston.

12. Apparatus as claimed in claim 7, in combination with said cashbox, said cashbox having a flap for closing the first aperture and a door for opening and closing the second aperture, said flap being retractable when the second aperture is opened.

13. Apparatus as claimed in claim 12, wherein the cashbox has a presser plate and mechanical return means tending to urge the plate towards the first aperture, such that the cashbox is able to contain the banknotes stacked between the presser plate and the first aperture, and the piston can penetrate into the first aperture and position the end of the stack at said predetermined location.

14. Apparatus as claimed in claim 7, further including means for sorting the banknotes withdrawn from the cashbox.

15. The apparatus of claim 14, further including a plurality of outlet boxes for receiving the sorted banknotes.

16. Apparatus for withdrawing banknotes from a cashbox, the apparatus comprising a housing for receiving a locked cashbox, the cashbox being openable within the housing in such a manner that banknotes cannot be manually extracted therefrom, and withdrawing means within the housing for withdrawing the banknotes from the cashbox, wherein a feeler device is movable parallel to the withdrawing means and operates to inhibit the operation of the apparatus if the feeler device encounters and obstacle.

17. Apparatus as claimed in claim 16, further including means for sorting the banknotes withdrawn from the cashbox.

18. Apparatus as claimed in claim 17, further including a plurality of outlet boxes for receiving the sorted banknotes.

* * * * *

UNITED STATES PATENT AND TRADEMARK OFFICE

CERTIFICATE OF CORRECTION

PATENT NO. : 5,655,763

DATED : August 12, 1997

INVENTOR(S) : Andre Gerlier

It is certified that error appears in the above-identified patent and that said Letters Patent is hereby corrected as shown below:

Col. 1, line 41, after "direction", insert --of the length, that is to say, in a direction--.

Col. 3, line 31, cancel "CH-57364" and insert --CH-573634--.

Col. 3, line 55, cancel "on" and insert --one--.

Claim 7, Col. 6, line 22, cancel "an" and insert --and--.

Claim 16, Col. 6, line 60, cancel "and" and insert --an--.

Signed and Sealed this

Fourteenth Day of July, 1998

Bruce Lehman

*Attest:*

BRUCE LEHMAN

*Attesting Officer*

*Commissioner of Patents and Trademarks*